United States Patent [19]

Ozawa

[11] Patent Number: 4,872,441

[45] Date of Patent: Oct. 10, 1989

[54] IGNITION CIRCUIT FOR INTERNAL COMBUSTION ENGINE

[75] Inventor: Masayuki Ozawa, Hyogo, Japan

[73] Assignee: Mitsubishi Denki Kabushiki Kaisha, Tokyo, Japan

[21] Appl. No.: 205,244

[22] Filed: Jun. 10, 1988

[30] Foreign Application Priority Data

Jun. 10, 1987 [JP] Japan ..... 62-89823[U]
Jun. 10, 1987 [JP] Japan ..... 62-89824[U]
Jun. 10, 1987 [JP] Japan ..... 62-89825[U]

[51] Int. Cl.[4] ..... F02P 3/12
[52] U.S. Cl. ..... 123/651; 123/617
[58] Field of Search ..... 123/617, 605, 612, 618, 123/649, 651

[56] References Cited

U.S. PATENT DOCUMENTS 4,561,412 12/1985 Saita et al. ..... 123/561
4,735,187 4/1988 Kato ..... 123/651

*Primary Examiner*—Raymond A. Nelli
*Attorney, Agent, or Firm*—Sughrue, Mion, Zinn, Macpeak and Seas

[57] ABSTRACT

An ignition circuit for an internal combustion engine includes an angle signal generating coil 1, an ignition control circuit 15, an ignition coil 16 and a bistable circuit connected between the angle signal generating coil and the ignition control circuit. The bistable circuit comprises a NPN transistor and a positive feedback circuit.

4 Claims, 4 Drawing Sheets

FIG. 5(a)
FIG. 5(b)
FIG. 5(c)
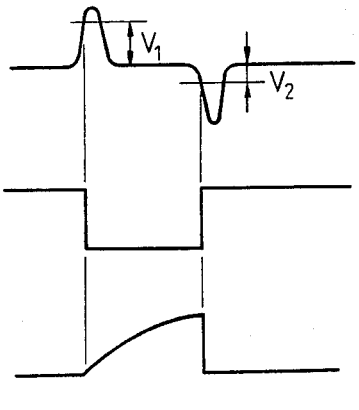
FIG. 6(a)
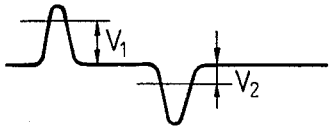
FIG. 6(b)
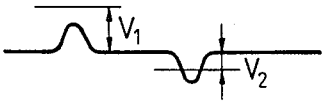
FIG. 7
PRIOR ART
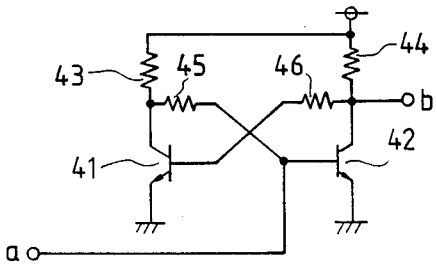

IGNITION CIRCUIT FOR INTERNAL COMBUSTION ENGINE

BACKGROUND OF THE INVENTION

The present invention relates to an ignition circuit for an internal combustion engine and, particularly, to such a circuit of the current cut-off type.

FIG. 4 is a circuit diagram of an example of a conventional ignition circuit of the type which includes a signal coil 1 for producing a positive and negative angle signal in synchronism with an engine rotation and a pair of parallel CR circuits 2, 3 and 4, 5 for noise suppression. The ignition circuit further includes a comparator 8 and an ignition control circuit 15 having an output connected to a primary coil of an ignition coil 16 whose secondary coil is connected to an ignition plug 17. The CR circuits have one ends connected together and to one end of the signal coil 1. The other ends of the CR circuits are connected through a backward connected diode 6 and a forward connected diode 7 to an inversion input of the comparator 8, respectively. A diode 9 is connected between the inversion input of the comparator 8 and a grounding point and a pair of series connected resistors 10, 11 and 12, 13 are inserted between a power source and the grounding point, respectively, a junction between the resistors 10 and 11 being connected to the inversion input of the comparator 8 and a junction between the resistors 12 and 13 being connected to a non-inversion input of the comparator 8. A resistor 14 is connected between an output of the comparator 8 and the non-inversion input thereof. The resistors 10 to 14 function to set the input level of the comparator 8 and constitute, together with the comparator 8, a bistable flip-flop circuit. The ignition control circuit 15 receives an output of the comparator 8 to calculate an ignition timing.

In operation, when the engine rotates, an angle signal such as shown by (a) in FIG. 5 is produced by the signal coil 1. The comparator 8 responds to a positive portion and a negative portion of this signal to change its output from H level to L level and from L level to H level, respectively. That is, when the voltage applied to the inversion input of the comparator 8 exceeds a voltage level V1 determined by the series resistors 10 and 11, the output of the comparator 8 becomes L level and, when it exceeds a voltage V2 determined by the series 12 and 13, the output becomes H level, as shown by (b) in FIG. 5. The output of the comparator 8 is supplied through the ignition control circuit 15 to the ignition coil 16 as shown by (c) in FIG. 5 and, at a current cut off time, a high voltage produced in the secondary coil of the ignition coil 16 is supplied to the plug 17 to form a spark discharge thereat.

The voltage level V2 is preliminarily set as being lower than the voltage level V1 by a suitable selection of resistances of the resistors 10 to 14, so that the ignition coil 16 is prevented from being supplied with a continuous current. That is, a magnitude of the angle signal produced by the signal coil 1 is proportional to engine rotation, the larger the magnitude being the higher the engine rotation as shown by (a) in FIG. 6 and otherwise as shown by (b) in FIG. 6. Therefore, in order to ensure that the ignition coil 16 is cut off at a low voltage during a low engine rotation such as during an engine starting or idling time, it is necessary to make V2 lower than V1 so that the circuit operation is performed on the negative portion of the angle signal.

The bistable flip-flop composed of the comparator 8 and the associated resistors is relatively complicated due to a relatively large number of circuit elements and associated wirings and expensive due to, particularly, the use of the comparator 8.

In order to solve this problem, it is necessary to avoid the use of the expensive comparator 8, firstly. FIG. 7 shows a flip-flop circuit which may be used as a substitution thereof. The flip-flop circuit shown in FIG. 7 comprises a pair of NPN transistors 41 and 42 and resistors 43 to 46 connected in a well known manner. The operation of this flip-flop is well known. Although this circuit is inexpensive, the problems of the necessity of relatively large number of circuit elements and the complicated wiring are left as they are.

SUMMARY OF THE INVENTION

An object of the present invention is to provide an ignition circuit of the type described previously, in which an input flip-flop is made simple and inexpensive.

According to the present invention, the input flip-flop comprises a NPN transistor, two resistive elements and an active circuit element. The active element may be a PNP transistor, a NAND circuit or a NOR circuit. The number of elements constituting the present input flip-flop if as small as four and does not require any complicated wiring.

BRIEF DESCRIPTION OF THE DRAWINGS

FIG. 5 shows a waveform of an angle signal;

FIG. 6 shows a change of amplitude of the angle signal with engine rotation: and FIG. 7 shows a conventional flip-flop circuit.

DETAILED DESCRIPTION OF THE PREFERRED EMBODIMENTS

Figure 1:
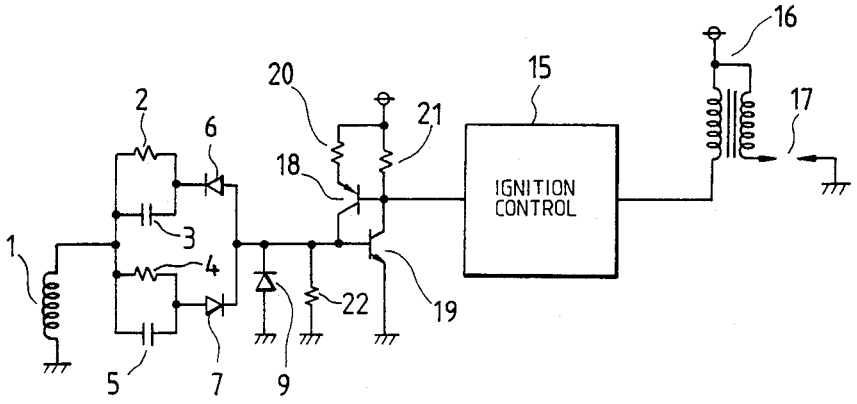
FIG. 1 is a circuit diagram of an ignition circuit including a bistable circuit according to an embodiment of the present invention.
Figure 4:
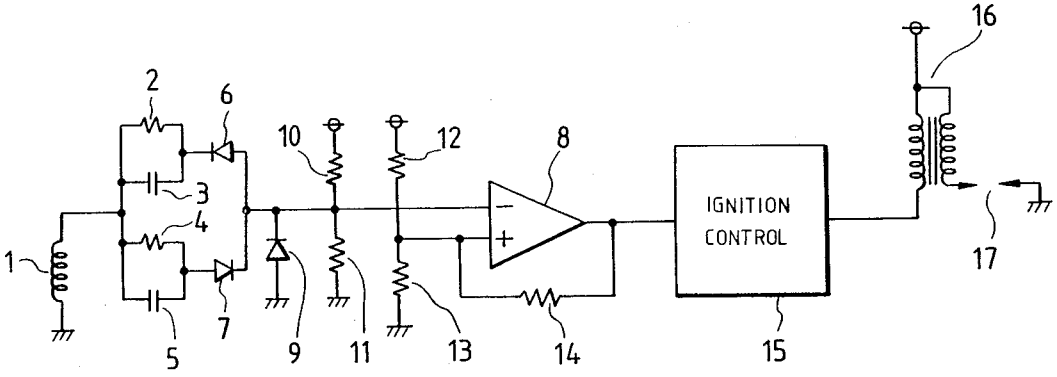
FIG. 4 PRIOR ART
FIG. 4 is a circuit diagram of a conventional ignition circuit.

In FIG. 1 which shows an embodiment of the present invention, circuit elements depicted by reference numerals 1 to 9 and 15 to 17 are the same as those of the conventional circuit shown in FIG. 4 depicted by the same reference numerals and, therefore, details thereof are omitted for avoidance of duplication. A reference numeral 18 depicts a PNP transistor having a collector connected to a base of an NPN transister 19 and to a junction of diodes 6 and 7, an emitter connected through a resistor 20 to a power source and a base connected through a resistor 21 to the power source, to the input of the ignition control circuit 15 and to the collector of the NPN transistor 19 whose emitter is grounded. A biasing resistor 22 is connected between the base and the emitter of the NPN transistor 19. The circuit elements 18 to 22 constitute an input flip-flop circuit of the present invention.

In operation, when an angle signal such as shown in FIG. 5 is produced by an angle coil 1 as in the case of the conventional circuit, the NPN transister 19 is turned on by a positive portion of the angle signal. Therefore, a current flows from the power source through a collector-emitter circuit of the NPN transistor 19 and a potential at a junction between the resistor 21 and the collector of the NPN transistor 19 becomes L level. Since a source voltage is applied through the PNP transistor 18 to the base of the NPN transistor 19, the conduction state of the latter is kept continuous to maintain the output level at L.

Then, when a negative portion of the angle signal from the angle coil 1 is supplied to the NPN transistor 19, the latter is turned off and thus the PNP transistor 18 is also turned off, causing the output level of the NPN transistor 19 to be H.

Voltage V1 by which the bistable circuit is set corresponds to a voltage $V_{BE}$ across the base and the emitter of the NPN transistor 19 and voltage V2 by which the flip-flop is reset can be lower than V1 since the NPN transistor 19 can be turned off by merely cancelling out the voltage applied to the base thereof. That is, the sensitivity of the flip-flop for the negative portion of the angle signal is higher than that for the positive portion thereof.

Figure 2:
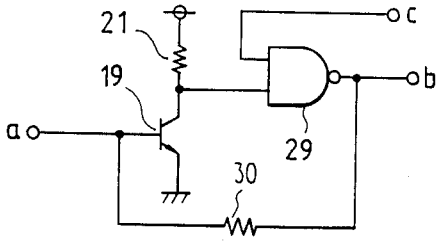
FIG. 2 is a circuit diagram of the input flip-flop circuit according to another embodiment of the present invention.

FIG. 2 shows another embodiment of the present invention, which differs from the embodiment in FIG. 1 in that a NAND circuit 29 is used instead of the PNP transistor 18. In FIG. 2, the NAND gate 29 which functions as a logic circuit has a first input connected to a control terminal c, a second input connected to a junction between the collector of the NPN transistor 19 and resistor 21 and an output connected to an output terminal b and through a resistor 30 to a base of the transistor 19.

When a H level signal is applied to the control terminal c, the transistor 19 is turned on by a H level signal applied to an input terminal a. Therefore, the potential at the second input of the NAND gate 29 becomes L level, causing the output b thereof to become H level. Thus, the transistor 19 is kept in the conduction state by the latter H level potential positive-fedback through the resistor 30 to the base thereof. Then, when a L level signal is applied to the input terminal a of the NPN transistor 19 is turned off and, therefore, potentials at the second input and the output terminal b become H and L, respectively. That is, so long as the potential at the control terminal c is H, the flip-flop circuit operates normally.

Then, where a L level signal is applied to the control terminal c, the output terminal b is kept at H level regardless of the potential at the input terminal a since the NAND gate 29 continues to provide H level output regardless of the potential at the second input thereof.

Figure 3:
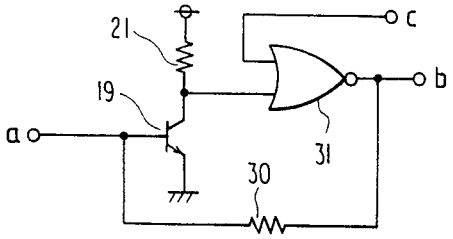
FIG. 3 is a circuit diagram of the input flip-flop circuit according to a further embodiment of the present invention.

FIG. 3 shows another embodiment which differs from the embodiment in FIG. 2 in that a NOR gate 31 is used instead of the NAND gate 29 in FIG. 2. In FIG. 3, when a H level signal is supplied to a control terminal c of the NOR gate 31, an output b thereof becomes L level regardless of a potential at a second input thereof, unlike the embodiment in FIG. 2. On the other hand, when a L level signal is supplied to the control terminal c, the output level of the NOR gate 31 depends upon the potential at the second input thereof. That is, when a H level signal is applied to the input terminal a, the NPN transistor 19 is turned on and the second input and the output terminal of the NOR gate 31 become L and H levels, respectively. When a L level signal is applied to the input terminal a, the NPN transistor 19 is turned off and the second input and the output terminal b of the NOR gate 31 become H and L levels, respectively, as in the usual flip-flop circuit.

As mentioned hereinbefore, the ignition circuit according to the present invention is simple in construction and hence inexpensive owing to the flip-flop circuit featured by the positive feedback circuit which makes the resistors for setting the signal level and the expensive comparator unnecessary.

What is claimed is:

1. An ignition circuit for an internal combustion engine, comprising: a signal coil (1) for producing an alternating angle signal in synchronism with the engine rotation, a bistable circuit responsive to said angle signal for providing an output having a first level and a second level corresponding to positive and negative portions of said angle signal, respectively, and an ignition control circuit (15) responsive to said output of said bistable circuit for calculating a desired ignition timing and controlling a current supply to an ignition coil (16), said bistable circuit including, exclusively, a semiconductor transistor (19) having a base electrode input connected to directly receive said angle signal and a collector electrode connected to a power supply through a resistor (21), an output connected to said ignition control circuit, and a positive feedback circuit, comprising an active circuit element (18; 29; 31) and a resistor (20; 30), connected in series between said collector electrode and said base electrode.

2. The ignition circuit as claimed in claim 1, wherein said transistor is an NPN transistor, and said active circuit element comprises a PNP transistor (18) having a base connected to said collector electrode and a collector connected to said base electrode.

3. The ignition circuit as claimed in claim 1, wherein said transistor is an NPN transistor, and said active circuit element comprises a NAND gate (29).

4. The ignition circuit as claimed in claim 1, wherein said transistor is an NPN transistor, and said active circuit element comprises a NOR gate (31).

* * * * *